US005145383A

United States Patent [19]

Bowen et al.

[11] Patent Number: 5,145,383

[45] Date of Patent: Sep. 8, 1992

[54] MALE ELECTRICAL CONTACT AND CONNECTOR EMBODYING SAME

[75] Inventors: David C. Bowen, Downers Grove; Russell J. Leonard, Naperville, both of Ill.

[73] Assignee: Molex Incorporated, Lisle, Ill.

[21] Appl. No.: 736,531

[22] Filed: Jul. 26, 1991

[51] Int. Cl.[5] ..... H01R 4/09

[52] U.S. Cl. ..... 439/78; 439/79; 439/83; 439/885

[58] Field of Search ..... 439/78–83, 439/876, 885

[56] References Cited

U.S. PATENT DOCUMENTS

| | | | |
|---|---|---|---|
| 4,740,180 | 4/1988 | Harwath et al. | 439/856 |
| 4,743,208 | 5/1988 | Weisenburger | 439/398 |
| 4,867,690 | 9/1989 | Thumma | 439/79 |
| 4,978,308 | 12/1990 | Kaufman | 439/78 |
| 4,995,819 | 2/1991 | Ohl | 439/79 |
| 5,015,192 | 5/1991 | Welsh et al. | 439/78 |
| 5,030,144 | 7/1991 | Seidler | 439/83 |

OTHER PUBLICATIONS

Byrnes, "Injectable Solderable Terminal Pins", Sep. 1966; IBM Tech. Disclosure Bulletin, vol. 9 No. 4, p. 366.

*Primary Examiner*—Paula A. Bradley
*Attorney, Agent, or Firm*—A. A. Tirva

[57] ABSTRACT

An electrical connector is disclosed with a housing having a through passage. A male electrical contact is stamped and formed from generally planar smooth metal material for mating with a female contact having a contact-engaging surface. The male contact includes a generally planar body portion which, when the male contact is mated with the female contact, is oriented generally perpendicular to the contact-engaging surface. The male contact includes a pin portion projecting from the body portion for engaging the contact-engaging surface of the female contact. The pin portion is twisted approximately 90° relative to and in the plane of the body portion to present a smooth side of the pin portion for engaging the contact-engaging surface of the female contact. The twisted area of the pin portion is press-fit into the through passage in the housing.

13 Claims, 2 Drawing Sheets

FIG.1
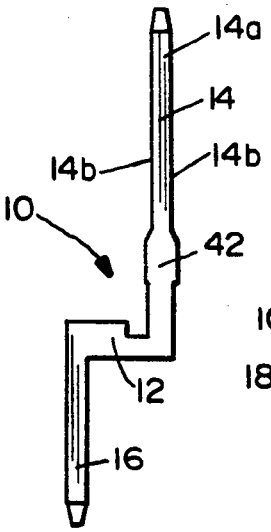
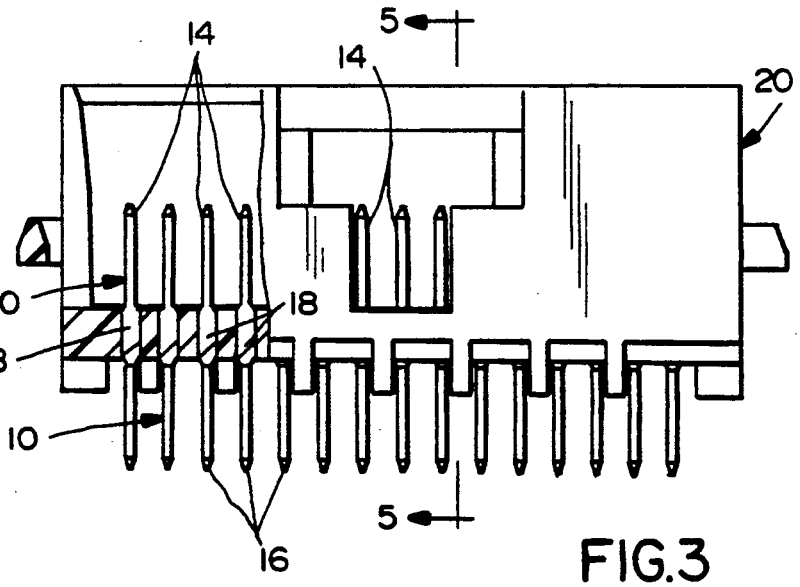
FIG.3
FIG.2
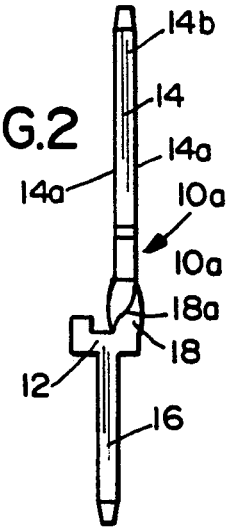
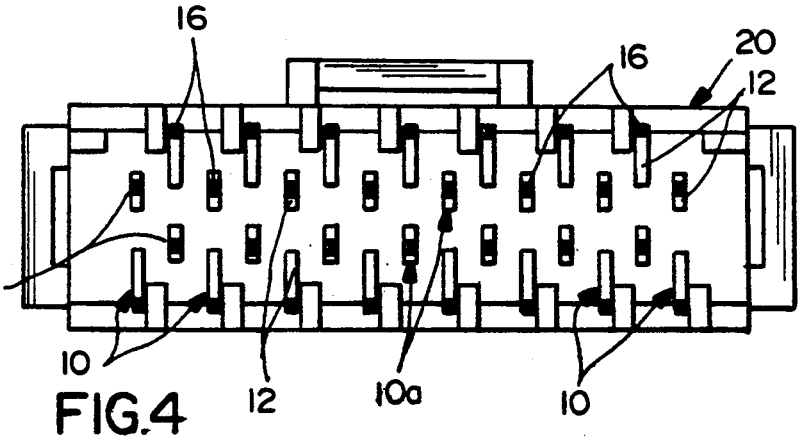
FIG.4
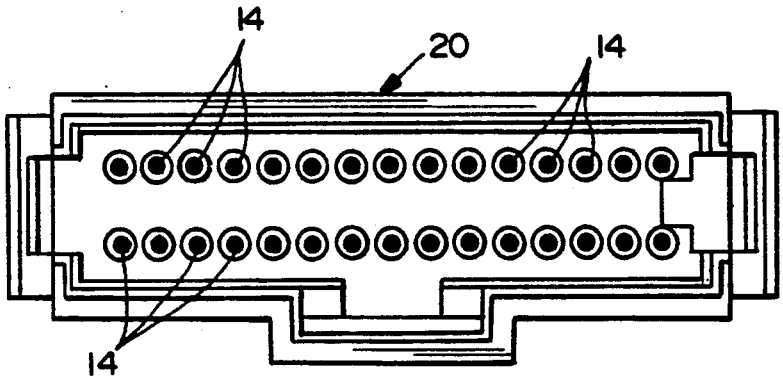
FIG.4A FIG.5
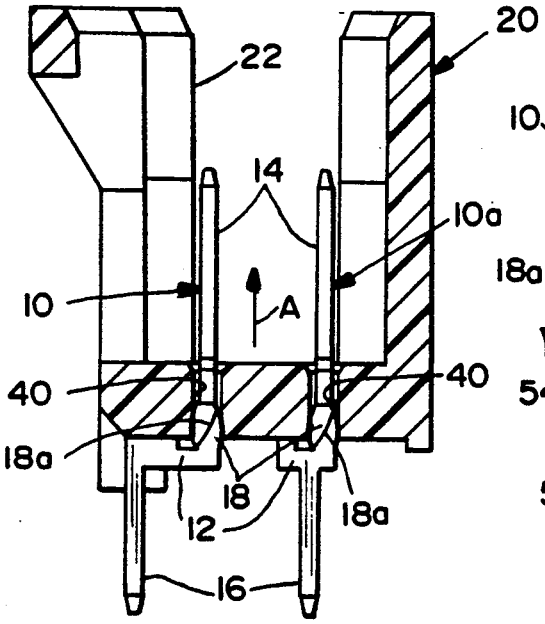
FIG.7
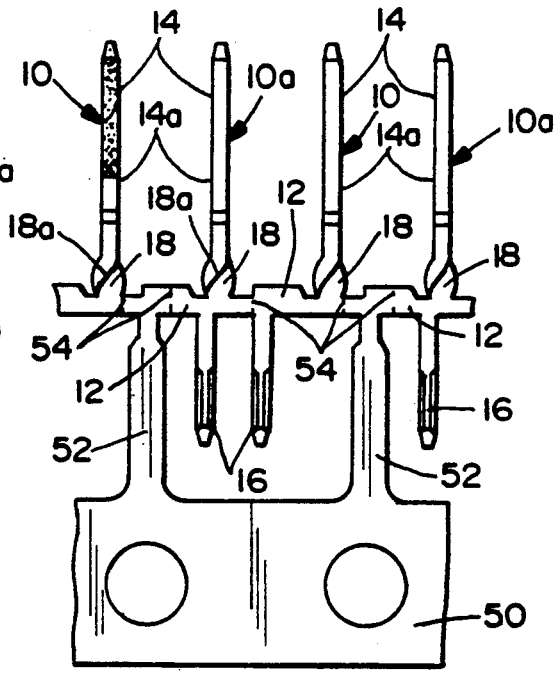
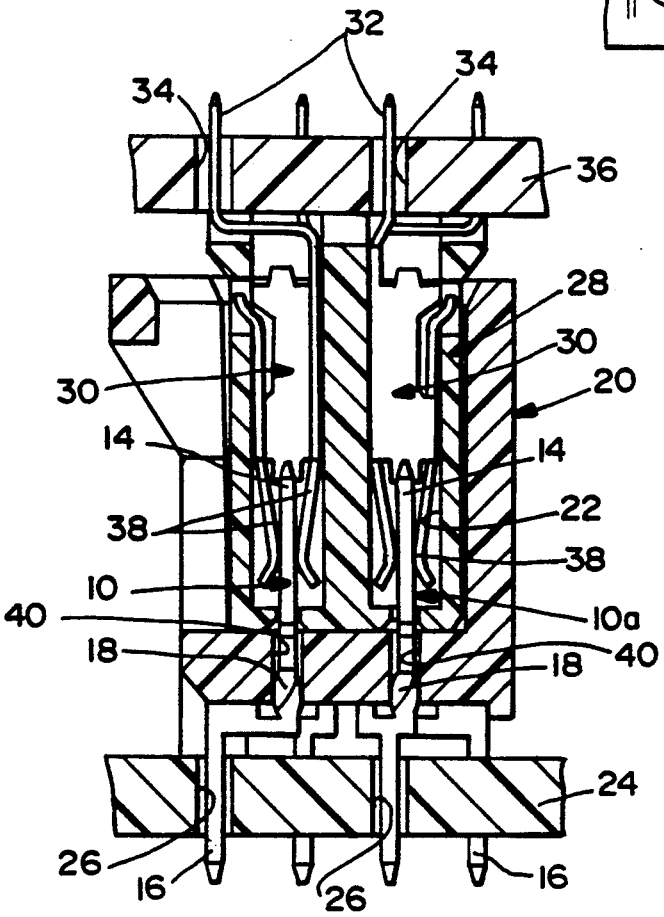
FIG.6

MALE ELECTRICAL CONTACT AND CONNECTOR EMBODYING SAME

FIELD OF THE INVENTION

This invention generally relates to the art of electrical connectors and, particularly, to a male or pin connector contact.

BACKGROUND OF THE INVENTION

Numerous electrical connector assemblies are interconnected by means of male and female contacts. Quite often, the contacts are stamped and formed from planar metal material or stock in a continuous manner using carrier strips joining a plurality of contacts, in a mass production environment.

A conventional female contact often is stamped from the flat metal stock and formed to include one or more spring arms for engaging the male contact. Usually, the spring arms are bent such that smooth surfaces of the metal stock are presented for engagement with the male contact. The male contact usually is stamped in a configuration which includes a body or mounting portion for mounting the male contact in an appropriate housing, and a pin portion projecting from the body for mating with the female contact.

One of the problems with electrical contacts and/or connectors of the character described is that the stamped edges or sides of the male contact pin are irregular or "rough" due to the nature of the stamping operation, in contrast to the smooth surfaces of the metal stock from which the contacts are stamped. If the rough sides of the male contact pin are presented for engagement with the female contact, inferior interconnections are made and, in situations of repeated interconnections and disconnections, scoring of the female contact results. This is particularly a problem in electrical contacts which are plated with a highly conductive or non-corrosive metal film. If the rough or stamped sides of the male contact repeatedly wipe over the plated surfaces of the female contact during repeated interconnections and disconnections, the plating literally is scraped off the female contact.

In order to solve these problems, various expedients have been utilized, such as deburring the male contact pins. This is an expensive process and extremely difficult with miniature connectors and contacts which are becoming prevalent in the electronic industry.

Another attempt to solve these problems has been to stitch or gang insert the pins into the insulator with their rough edges perpendicular to the smooth surfaces of the female contact. However, this presents a problem in mass production environments wherein the contacts, along with their continuous carrier strips, are rolled on a reel after the stamping process, for use in subsequent assembly processes of the electrical connector itself. If the tail of the male contact is bent out of the plane of the body portion thereof, damage or deformation of the contact often occurs during storage of the contacts and the carrier strips on the reel.

It should be understood that a solution to the problem is not simply to mount the male contacts in a connector housing such that the smooth surfaces of the pin portion always are oriented for presentation to the smooth portions of the female contact. It often is desirable to mount or insert the male contacts into elongated housings or headers in pairs, with the planes of the stamped contacts generally perpendicular to the elongated direction of the header and perpendicular to the flat contact-engaging surfaces of the female contact. With such mass assembly operations, the rough or stamped sides of the male contact are oriented for presentation to the smooth surfaces of the female contact.

Still another problem in the manufacture of electrical connectors using stamped and formed contacts is the provision of means for securing the contacts within a connector housing or header which, conventionally, is molded of dielectric material such as plastic or the like. A simple securing means is to provide barbs on the contact, such as the pin portion of a male contact, for biting into the plastic material within a respective passage in the housing or header. The extremely small contacts also render a simple press-fit of the contacts in respective passages in the housing ineffective, as the size of the connectors/contacts continue to become extremely small.

This invention is directed to solving these rather complex problems in an extremely simple and effective manner.

SUMMARY OF THE INVENTION

An object, therefore, of the invention is to provide a new and improved male electrical contact, along with a connector assembly embodying the contact.

In the exemplary embodiment of the invention, the male contact is stamped and formed from generally planar smooth metal material for mating with a female contact having at least one contact-engaging surface. The male contact includes a generally planar body portion which, when the male contact is mated with the female contact, is oriented generally perpendicular to the contact-engaging surface. A pin portion projects from the body portion for engaging the contact-engaging surface of the female contact. The pin portion is twisted approximately 90° relative to and in the plane of the body portion to present a smooth side of the pin portion for engaging the contact-engaging surface of the female contact.

As disclosed herein, the majority of the pin portion of the male contact is generally straight, with a twisted area thereof adjacent the body portion. The invention is disclosed in a connector for mounting to a printed circuit board, and the male contact includes a solder tail portion projecting from the body portion opposite the pin portion. The solder tail portion is generally coplanar with the body portion.

The invention contemplates that the male contact be mounted in a connector housing or header which has a through passage for receiving and mounting the contact. The assembly is configured such that the twisted area of the pin portion of the contact performs a dual function of securing the male contact in the housing by locating the twisted area in the through passage of the housing. In other words, the twisted area becomes "enlarged" relative to the pin portion of the contact and presents edges which secure the contact in the housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is an elevational view of an electrical male contact according to the invention, in its original stamped configuration;

FIG. 2 is a view similar to that of FIG. 1 with a similar male contact in its twisted configuration;

FIG. 3 is a fragmented elevational view of an electrical connector mounting a plurality of the male contacts;

FIG. 4 is a bottom plan view of the electrical connector of FIG. 3;

FIG. 4A is a top plan view of the electrical connector of FIG. 3;

FIG. 5 is a vertical section through an electrical connector housing or header mounting a pair of male contacts according to the invention;

FIG. 6 is a view similar to that of FIG. 5, with the electrical connector mated to a complementary connector having female contacts; and FIG. 7 is a plan view of a continuous carrier strip stamped and formed with a plurality of the male contacts connected to the carrier strip.

DETAILED DESCRIPTION OF THE PREFERRED EMBODIMENT

Referring to the drawings in greater detail, and first to FIG. 1, an electrical male contact, generally designated 10, is illustrated as it would be stamped from generally planar smooth metal material or stock. The contact includes a generally planar body portion 12, a male pin portion 14 and a solder tail portion 16. This generally flat contact has not yet been formed according to the invention. However, this depiction is intended to show that, in its generally flat stamped configuration, male pin portion 14 of the contact will include opposite smooth sides 14*a* and opposite "rough" sides 14*b*. In other words, the smooth sides 14*a* of the pin correspond to the smooth sides of the metal stock from which the contact is stamped. The rough sides 14*b* are the stamped or cut sides of the pin and, as is known, will include burrs or rough edges resulting from the stamping operation.

FIG. 2 shows a male contact similar to that of FIG. 1, except for the fact that body portion 12 is somewhat shorter. This simply is for location purposes of the pin and solder tail portions in an appropriate connector housing. Suffice it to say, the male contact in FIG. 2 is generally designated 10*a* and also includes a pin portion 14, a body portion 12 and a solder tail portion 16 corresponding to like numbered portions designated in FIG. 1. However, the invention contemplates that either male contacts 10 or 10*a* be twisted, in an area designated 18, whereby pin portion 14 is twisted approximately 90° relative to and in the plane of body portion 12, in order to reorient smooth sides 14*a* of the contact. The reorientation of the smooth sides of the contact results in presenting the smooth sides for engagement with contact-engaging surfaces of a female contact, as will be illustrated hereinafter.

FIGS. 3–5 show male contacts 10 and 10*a* mounted in an electrical connector housing or header, generally designated 20. It can be seen that the header is elongated and the contacts are mounted in pairs of contacts 10 and 10*a* transversely of the header. As seen best in FIG. 5, the pin portion 14 of the contacts project upwardly into a receptacle cavity 22. As seen FIG. 4, the pairs of contacts alternate in their own orientations whereby there is an array of four rows of solder tail portions projecting from the bottom of the header. However, as seen in FIG. 4A, there is an array of only two male pin portions 14 projecting upwardly from the header. This is why body portion 12 of contact 10*a* is shorter than bôdy portion 12 of contact 10, as described above. FIG. 5 shows how the pairs of contacts 10, 10*a* are mounted in the header transversely thereof.

Although it must be understood that the concepts of the invention are applicable for a wide variety of electrical connector header configurations, FIGS. 3–5 are depicted to illustrate that, in many instances, contacts are mounted or inserted into electrical connectors in pairs or other groupings whereby the smooth sides or rough sides of the pin portions of the contacts may not be in a desirable orientation for mating with female contacts of a complementary connector.

Specifically, reference is made to FIG. 6 wherein it can be seen that header 20, including contacts 10 and 10*a*, is mounted to a printed circuit board 24. It can be seen that solder tail portions 16 project through holes 26 in the board. The solder tails are soldered to circuit traces on the board and/or in the holes, as is known in the art.

In FIG. 6, header 20 is shown mated with a complementary plug connector, generally designated 28, which is mated or plugged into receptacle cavity 22. The complementary connector includes appropriate female contacts, generally designated 30, which have solder tail portions 32 projecting through holes 34 in a second printed circuit board 36. Again, as is known, solder tail portions 32 are soldered to circuit traces on board 36 and/or in the holes thereof. Like male contacts 10 and 10*a*, female contacts 30 are stamped and formed from metal material or stock, and each female contact includes a pair of spring arms or fingers 38 which define a female contact receptacle for receiving pin portions 14 of the male contacts. These spring arms of the female contacts are formed and oriented so that smooth sides thereof (corresponding to the smooth sides of the metal stock) are presented inwardly or in opposing relationship for engaging the pin portions of the male contacts.

From the foregoing description of the mated electrical connectors in FIG. 6, it can be understood from the above description of male contacts 10 and 10*a* in FIGS. 1 and 2, that by twisting the male contacts in twisted areas 18 (FIG. 2), the smooth sides 14*a* of pin portions 14 of the male contacts are presented to the smooth contact-engaging surfaces of spring arms 38 of the female contacts. Therefore, extraneous operations to smooth the "rough" or stamped sides of the pin portions of the male contacts is unnecessary.

In addition, as seen in FIGS. 5 and 6, twisted areas 18 of the male contacts are located in passages 40 of header 20. As stated above, with the ever-increasing miniaturization of electrical connectors such as those illustrated herein, difficulties are encountered in securing the male contacts in their respective header. For instance, pin portions 14 of the male contacts may be as small as on the order of 0.015 inch. When the pin portions are twisted, twisted area 18 not only enlarges these dimensions in a peripheral concept, but spiral edges 18*a* (FIG. 2) are created. Although the male contacts have an enlarged portion 42 (FIG. 1), it can be seen in FIG. 2 how twisted area 18 further enlarges the cross dimensions of that area. Then, looking at FIG. 5, it can be seen how the twisted area press-fits into passages 40 in header 20. During the assembly operation of inserting pin portions 14 into header 20, as indicated by arrow "A" in FIG. 5, it can be seen how pin portions 14 can be easily and freely inserted through the passages until enlarged twisted areas 18 are press-fit into the passages to secure the male contacts therein. Therefore, the twists in the male contacts perform the dual function of reorienting the smooth sides of the pin portions of the contacts and also provide an enlarged area for securing the contacts in appropriate passages in connector housings.

Lastly, FIG. 7 shows how male contacts 10 and 10*a* are fabricated from a continuous strip of metal stock which, as is conventional, includes a carrier strip 50 and webs 52 joining the contacts to the carrier strip. It can be seen that the male contacts, having been stamped to form body portions 12, pin portions 14 and solder tail portions 16, have been twisted, as at 18, from their original stamped configuration as described in relation to FIG. 1. Pin portions 14 also may be plated, as illustrated by the left-hand male contact 10 in FIG. 7.

The significance of FIG. 7 is to illustrate that by twisting the pin portions of the male contacts, the pin portions still remain in the plane of the continuous strip of metal stock even after all of the operations of stamping, twisting and plating have been performed. This is advantageous because the continuous strip now can be rolled into reel form and transported to a subsequent assembly station for mounting the contacts into a respective connector housing or header. In contrast to prior processes wherein the pin portions literally were bent out of the plane of stock, with the twisting concept of the invention, the pin portions remain in the original plane of the stamped and formed metal stock so that there are no projecting portions of the male contacts which can be damaged or deformed during handling, storage and the like.

Of course, before assembling the male contacts into a connector housing or header, the contacts will be cut along lines 54 (FIG. 7) so that the contacts are in the configurations illustrated in FIGS. 1 and 2 before the contacts are inserted, in pairs, into header 20, as described above, by appropriate tooling.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A male electrical contact stamped and formed from generally planar smooth metal material for mating with a female contact having a contact-engaging surface, the male contact including a generally planar body portion, which, when the male contact is mated with the female contact, is oriented generally perpendicular to said contact-engaging surface, and a pin portion projecting from the body portion for engaging the contact-engaging surface of the female contact, the pin portion being twisted approximately 90° relative to and in the plane of the body portion to present a smooth side of the pin portion for engaging the contact-engaging surface of the female contact.

2. The male electrical contact of claim 1 including a solder tail portion projecting from the body portion opposite said pin portion.

3. The male electrical contact of claim 2 wherein said solder tail portion is generally coplanar with the body portion.

4. The male electrical contact of claim 1 wherein the majority of said pin portion is generally straight, with a twisted area thereof adjacent the body portion.

5. In combination with the male electrical contact of claim 4, a housing having a through passage, and wherein said twisted area is press-fit into the passage.

6. An electrical connector, comprising:

a housing having a through passage; and a male contact stamped and formed from generally planar smooth metal material for mating with a female contact having a contact-engaging surface, the male contact including a generally planar body portion which, when the male contact is mated with the female contact, is oriented generally perpendicular to said contact-engaging surface, and a pin portion projecting from the body portion for engaging the contact-engaging surface of the female contact, the pin portion being twisted approximately 90° relative to and in the plane of the body portion to present a smooth side of the pin portion for engaging the contact-engaging surface of the female contact, the twisted area of the pin portion being press-fit into the through passage in the housing.

7. The electrical connector of claim 6 wherein said male contact includes a solder tail portion projecting from the body portion opposite said pin portion.

8. The electrical connector of claim 7 wherein said solder tail portion is generally coplanar with the body portion.

9. A male electrical contact stamped and formed from generally planar smooth metal material thereby having opposite smooth sides and opposite stamped sides, the male contact including a generally planar body portion and a pin portion projecting from the body portion, the pin portion being twisted approximately 90° relative to and in the plane of the body portion to reorient the smooth sides of the pin portion relative to the smooth sides of the body portion.

10. The male electrical contact of claim 9 including a solder tail portion projecting from the body portion opposite said pin portion.

11. The male electrical contact of claim 10 wherein said solder tail portion is generally coplanar with the body portion.

12. The male electrical contact of claim 9 wherein the majority of said pin portion is generally straight, with a twisted area thereof adjacent the body portion.

13. In combination with the male electrical contact of claim 12, a housing having a through passage, and wherein said twisted area is press-fit into the passage.

* * * * *